US005328735A

United States Patent [19]

Okazaki et al.

[11] Patent Number: 5,328,735

[45] Date of Patent: Jul. 12, 1994

[54] PROCESS FOR PRODUCING FIXING ROLLER

[75] Inventors: Hiroshi Okazaki; Masaya Nishi; Chiaki Kato, all of Osaka, Japan

[73] Assignee: Sumitomo Electric Industries, Ltd., Osaka, Japan

[21] Appl. No.: 921,096

[22] Filed: Jul. 29, 1992

[51] Int. Cl.[5] ..... B05D 1/28

[52] U.S. Cl. ..... 427/428; 118/232; 118/258; 118/259

[58] Field of Search ..... 427/428; 118/252, 244, 118/232, 258, 259, 249; 219/216

[56] References Cited

U.S. PATENT DOCUMENTS

| | | | |
|---|---|---|---|
| 2,511,625 | 6/1950 | Dungler | 118/412 |
| 3,508,523 | 4/1970 | Meerleer | 427/428 |
| 4,819,020 | 4/1989 | Matsushiro et al. | 219/216 |
| 5,035,950 | 7/1991 | Del Rosario | 219/216 |
| 5,123,151 | 6/1992 | Uehara et al. | 219/216 |

*Primary Examiner*—Shrive Beck
*Assistant Examiner*—Katherine A. Bareford
*Attorney, Agent, or Firm*—Sughrue, Mion, Zinn, Macpeak & Seas

[57] ABSTRACT

A process for producing a fixing roller comprising coating a fluorine resin dispersion onto a core by using a transfer coating apparatus comprising a transfer roller equipped with a fluorine resin dispersion temperature controller, a coating pan containing a fluorine resin dispersion, a driving system for revolving the core, and a core carrying mechanism for shifting the core, in which the core is brought close to the transfer roller at a gap allowing the core to pick up the fluorine resin dispersion having been picked up from the coating pan onto the transfer roller, and after a prescribed amount of the fluorine resin dispersion is transferred onto the core, the gap between the core and the transfer roller is widened by shifting the core away from the transfer roller thereby to separate the core from the transfer roller, the coating apparatus further comprising a thin plate on both sides of the transfer roller for preventing the fluorine resin dispersion in contact with both ends of an effective coating width of the core from migrating to the inside of the effective coating width while the gap is widened.

7 Claims, 3 Drawing Sheets

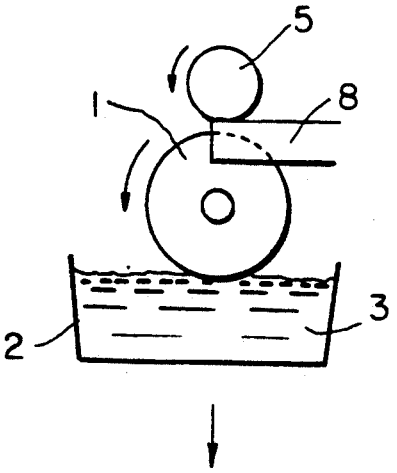
FIG. 2
FIG. 3
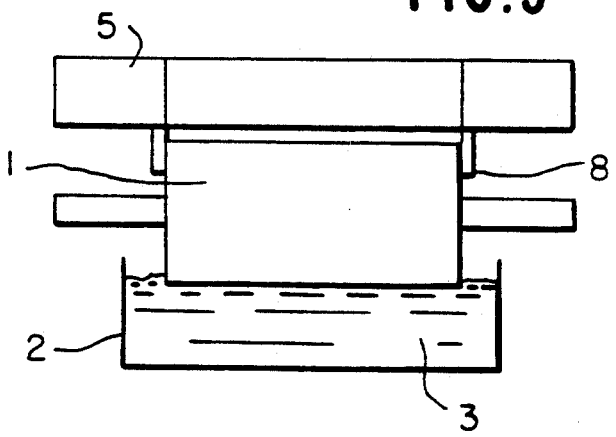
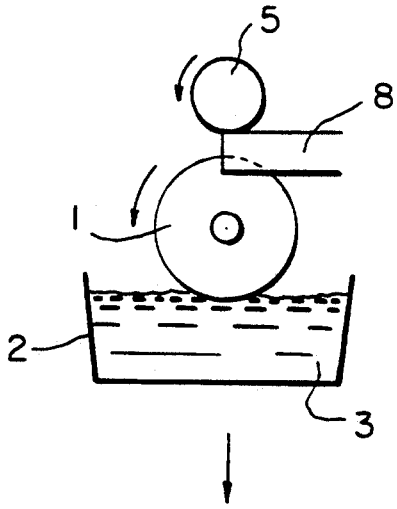
FIG. 4
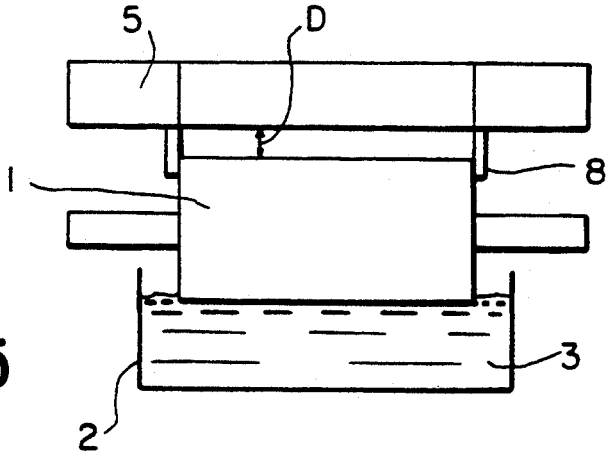
FIG. 5

PROCESS FOR PRODUCING FIXING ROLLER

FIELD OF THE INVENTION

The present invention relates to a process for producing a fixing roller to be used in a fixing part of copying machines, line printers, facsimiles, etc.

BACKGROUND OF THE INVENTION

A fixing part of copying machines, etc. usually has the system shown in FIG. 8 from the standpoint of safety and economy, in which paper 33 having thereon toner image 32 is passed between fixing hot roller 30 and fixing pressure roller 31 whereby the toner image is fixed on the paper as fixed image 40 by applying heat (usually 170° to 200° C.) and pressure.

Fixing hot roller 30 used in this fixing system is generally composed of a base made of metals (e.g., aluminum), ceramics or heat-resistant plastics, i.e., roller core 34, having coated thereon a fluorine resin to a thickness of several dozens of microns to form release coat 35. In FIG. 8, numeral 36 denotes a core of pressure roller 31, 37 denotes a core of pressure roller 31, 38 and 39 each denotes a scraper, and 41 denotes a heater.

Where the fluorine resin coat on a cylindrical core, such as a core of a fixing roller, is formed by spray coating or electrostatic coating of a resin dispersion followed by baking, the baked resin coat has large roughness so that surface finishing by polishing is needed. In some cases, the baked and polished coat must be re-baked to remove the scratches caused by polishing.

On the other hand, the fluorine resin coat can also be formed by transfer coating in which a resin dispersion in a coating pan is once picked up with a transfer roller and the transfer roller having the resin dispersion thereon is brought close to a core to transfer the resin dispersion to the core. According to the transfer coating system, since the baked resin coat has a uniform and smooth surface free from waviness, there is no need to polish and re-bake the baked coat. However, when the transfer of the fluorine resin dispersion from the transfer roller to the core is cut off, a part of the coat has a larger coating build-up, making it difficult to obtain a uniform coat thickness over the entire coated area. The difference in coat thickness between such a build-up part and the rest sometimes reaches 30 μm or more. This being the case, the resulting resin-coated roller, when used as a fixing roller of a copying machine, causes copying disorders, such as poor fixing of a toner image and wrinkles of copying paper, or problems of appearance, such as a difference in color density between the part having a larger coating build-up and the part of smaller coating build-up or development of streaks.

SUMMARY OF THE INVENTION

An object of the present invention is to provide a process for producing a fixing roller having a coat of a fluorine resin dispersion.

Other objects and effects of the present invention will be apparent from the following description.

The present invention relates to a process for producing a fixing roller comprising coating a fluorine resin dispersion by direct or indirect transfer coating onto a cylindrical core by using a transfer coating apparatus comprising a transfer roller equipped with a fluorine resin dispersion temperature controller, a coating pan containing a fluorine resin dispersion, a driving system for revolving the core, and a core carrying mechanism for shifting the core, in which the core is brought close to the transfer roller at a gap allowing the core to pick up the fluorine resin dispersion having been picked up from the coating pan onto the transfer roller, and after a prescribed amount of the fluorine resin dispersion is transferred onto the core, the gap between the core and the transfer roller is widened by shifting the core away from the transfer roller thereby to separate the core from the transfer roller, the coating apparatus further comprising a thin plate on both sides of the transfer roller for preventing the fluorine resin dispersion in contact with both ends of an effective coating width of the core from migrating to the inside of the effective coating width while the gap is widened.

The process of the present invention embraces preferred embodiments wherein:

(1) the fluorine resin dispersion has a viscosity of from 10 to 200 cp, (2) the fluorine resin dispersion comprises polytetrafluoroethylene (hereinafter abbreviated as "PTFE"), a tetrafluoroethylene-perfluoroalkyl vinyl ether copolymer (hereinafter abbreviated as "PFA"), or a mixture of PTFE and PFA, each of which may contain an organic high polymer, (3) the fluorine resin dispersion is an aqueous dispersion comprising a fluorine resin, e.g., PTFE, a coloring pigment, and at least 1% by weight of an organic high polymer for improving adhesion to the core, e.g., an acrylic resin, polyamide-imide, polyimide, polyphenylene sulfide and polyether sulfone, (hereinafter referred to as a "primer dispersion"), and the gap between the transfer roller and the core at the time when the core having picked up a prescribed amount of the primer dispersion is separated from the transfer roller (hereinafter referred to as a "gap at the time of separation") is from 2 to 20 mm, (4) the fluorine resin dispersion is an aqueous dispersion comprising from 20 to 70% by weight of PTFE and, if desired, from 0.2 to 5% by weight of a filler and, if further desired, a coloring pigment (hereinafter referred to as a "topcoating PTFE dispersion"), and the gap at the time of separation is from 2 to 30 mm, and (5) the fluorine resin dispersion is an aqueous dispersion comprising from 20 to 70% by weight of PFA (hereinafter referred to as a "topcoating PFA dispersion"), and the gap at the time of separation is from 2 to 30 mm.

All percents used herein for the composition of the fluorine resin dispersion are based on the total solid content of the fluorine resin dispersion.

BRIEF DESCRIPTION OF THE ACCOMPANYING DRAWINGS

FIG. 1 is a front view of one embodiment of the whole transfer coating system according to the present invention.

FIGS. 2, 4, and 6 and FIGS. 3, 5, and 7 are front views and side views, respectively, illustrating one embodiment of the process for producing a fixing roller according to the present invention.

FIG. 8 illustrates a fixing part of an ordinary copying machine.

DESCRIPTION OF THE PREFERRED EMBODIMENT

Figure 1:
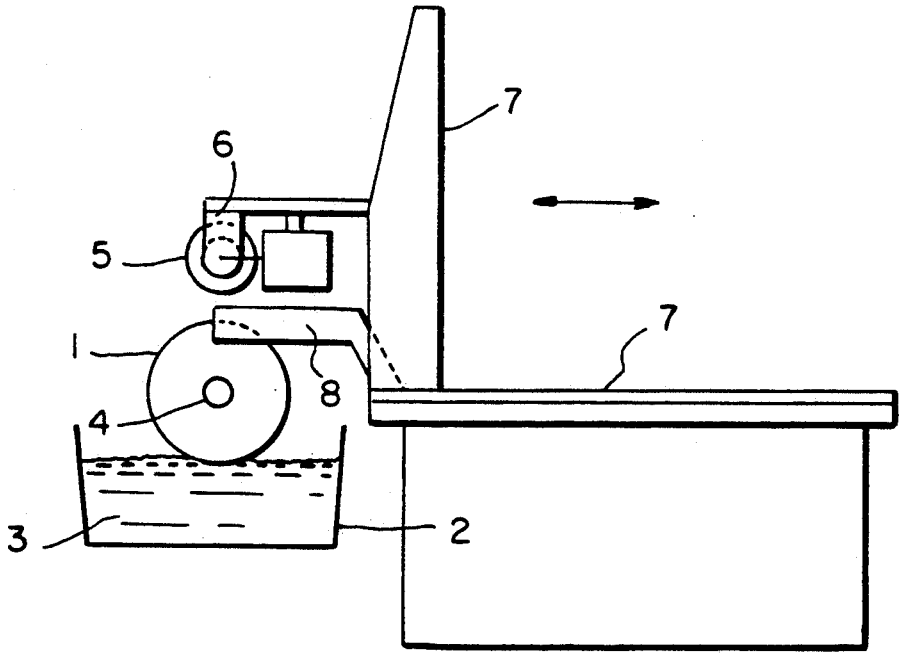

FIG. 1 schematically illustrates one embodiment of a transfer coating system used in the process for producing a fixing roller according to the present invention, but the present invention is not construed as being limited to this embodiment.

The transfer coating apparatus shown in FIG. 1 comprises transfer roller 1, coating pan 2, resin dispersion 3, resin dispersion temperature controller (e.g., a cooling water circulator 4), cylindrical core 5, core driving system 6, core carrying mechanism 7, and thin plate 8. The dispersion temperature controller is for maintaining the dispersion temperature constant to control the dispersion viscosity thereby stabilizing the pickup of the dispersion.

The material of the cylindrical core is not particularly limited. Examples thereof include metals (e.g., aluminum, an aluminum alloy) and iron, ceramics, and heat-resistant plastics.

One embodiment of the process for producing a fixing roller according to the present invention will be described in detail below by referring to FIGS. 2 through 7, but the present invention is not construed as being limited to this embodiment.

A core is firstly brought close to a transfer roller at a gap allowing the core to pick up a fluorine resin dispersion having been picked up onto the transfer roller.

FIGS. 2 and 3 are a front view and a side view, respectively, of the transfer coating system according to the present invention, in which fluorine resin dispersion 3 picked up from coating pan 2 onto transfer roller 1 is being transferred to core 5. In this stage, thin plate 8 is in contact with the side edge of transfer roller 1 and cylindrical core 5.

Cylindrical core 5 is then shifted upward by the core carrying mechanism, and at the same time, thin plate 8 also moves upward while being in contact with transfer roller 1 and cylindrical core 5. A thin film of the dispersion is formed over transfer roller 1, thin plate 8 and core 5 by surface tension of the dispersion.

FIGS. 3 and 4 are a front view and a side view, respectively, of the transfer coating system, in which core 5 is shifted from the position of FIGS. 2 and 3 to make gap D from transfer roller 1. The vertical movement of thin plate 8 is so restricted that thin plate 8 does not move upward exceeding the position of FIGS. 4 and 5.

Cylindrical core 5 is then further shifted upward and separated from thin plate 8 since the upward movement of thin plate 8 is restricted. As a result, the thin film of the dispersion formed over transfer roller 1, thin plate 8 and core 5 is broken, and core 5 is cut off from transfer roller 1.

Figure 6:
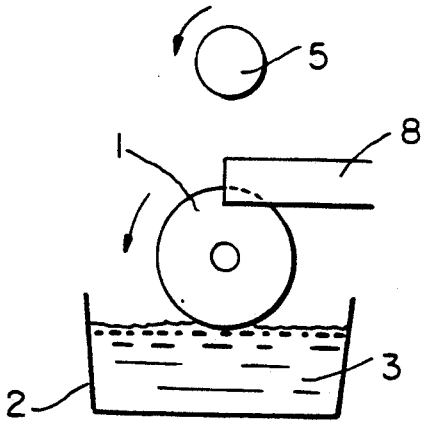
Figure 7:
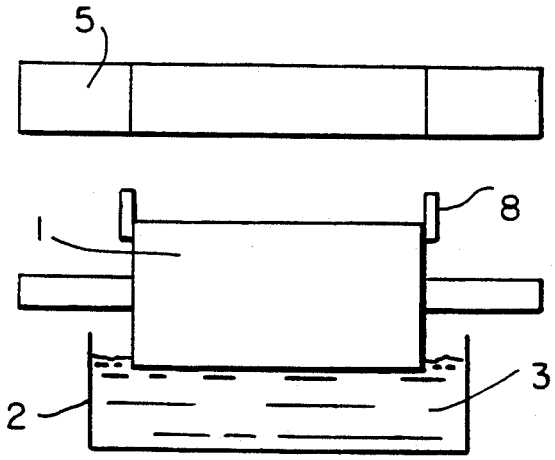
Figure 8:
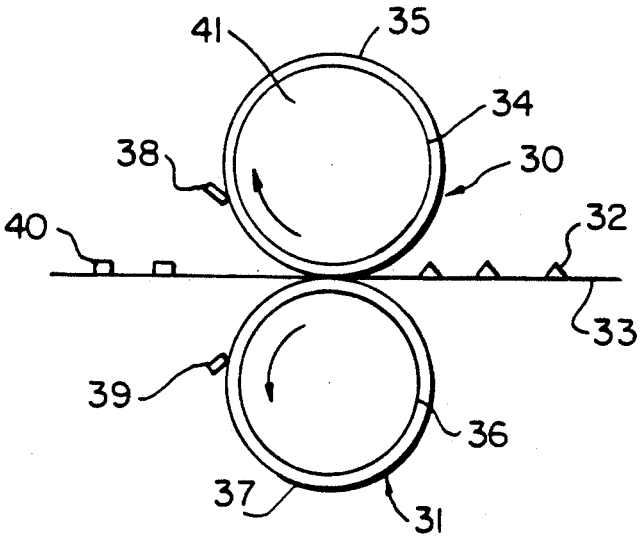

FIGS. 6 and 7 are a front view and a side view, respectively, of the transfer coating system, in which core 5 is further shifted and separated from transfer roller 1.

In the embodiments shown in FIG. 1 and FIGS. 2 to 7, the end of the thin plate is positioned at the thin film of the fluorine resin dispersion, but the position and shape of the thin plate are not particularly limited as long as the thin plate is in contact with the thin film of the dispersion. For example, the end of the thin plate may be extended over the position of the thin film of the dispersion.

For the settlement of the above-described problems associated with the conventional transfer coating technique, it is necessary to give considerations to the coating conditions, for example a viscosity of the fluorine resin dispersion. That is, when the fluorine resin dispersion having been picked up around a transfer roller and the dispersion having been picked up around a core is cut off, in order to minimize the difference in coating thickness between a part having a larger coating build-up and the other part, particularly to reduce the difference below 30 μm, it is required to optimize the cutting method. The optimum method should be decided taking physical properties of the fluorine resin dispersion, e.g., viscosity resistance, capillarity, and surface tension, into consideration as well.

The inventors of the present invention have conducted extensive investigations with all these considerations and, as a result, found that a transfer roller and a core can be effectively separated apart by a method in which a movable thin plate is provided on both sides of the transfer roller for preventing a fluorine resin dispersion in contact with both ends of the effective coating width of the core (the required coating length of the core in the axial direction) from migrating inside the effective coating width while the gap D between the transfer roller and the core is widened after a prescribed amount of the dispersion is picked up onto the core. In this method, a thin film of the dispersion is formed over the transfer roller, the thin plates on both sides of the transfer roller, and the core by surface tension of the dispersion, and the gap is widened until the thin film is broken.

A fluorine resin dispersion generally has a viscosity of from 200 to 300 cp and roughly includes the following three types:

(a) a primer dispersion to be used for enhancing adhesion of a fluorine resin to a core, (b) a topcoating PTFE dispersion to be coated on a primer layer to endow a core with functions as a fixing roller, and (c) a topcoating PFA dispersion to be coated on a primer layer to endow a core with functions as a fixing roller.

Primer dispersion (a) generally comprises PTFE and/or PFA as a fluorine resin, not less than 1% by weight of an organic high polymer for adhesion enhancement (e.g., acrylic resins, polyamide-imide, polyimide, polyphenylene sulfide, and polyether sulfone), a coloring pigment, and a surface active agent for assisting these components to be dispersed in water.

Topcoating PTFE dispersion (b) generally comprises from 20 to 70% by weight of PTFE and, if desired, from 0.2 to 5% by weight of a filler for improving various characteristics after film formation, and if further desired, a coloring pigment, and a surface active agent for assisting these components to be dispersed in water.

Topcoating PFA dispersion (c) generally comprises from 20 to 70% by weight of PFA and a surface active agent for assisting PFA, etc. to be dispersed in water.

If these fluorine resin dispersions with their viscosity uncontrolled are coated by the transfer coating according to the present invention, it tends to be difficult to obtain a desired resin coating thickness. When the resin dispersion having been picked up around a transfer roller and that being picked up around a core are cut apart, the resin thickness difference between a part with a larger coating build-up and the other part tends to be large, and such a large thickness difference cannot be reduced without difficulty, resulting in a poor coating appearance due to appreciable color unevenness after baking. It has now been found that this can be avoided by controlling the viscosity of the fluorine resin dispersion. The viscosity of the fluorine resin dispersion used in the present invention is preferably from 10 to 200 cp, and more preferably from 20 to 80 cp. If the viscosity exceeds 200 cp, the difference in resin coating thickness tends to exceed 30 μm, often causing appearance problems as stated above. If it is less than 10 cp, a satisfactory resin coat for practical use tends not to be obtained.

Viscosity control of the fluorine resin dispersion can appropriately be effected by dilution, for example, with pure water or a viscosity modifying liquid comprising a surface active agent. The solid content of the fluorine resin dispersion is generally from 20 to 70% by weight.

In order to coat a fluorine resin dispersion uniformly and to minimize the coating thickness difference, it is preferred that the method of cutting the fluorine resin dispersion according to the present invention be combined with the above-mentioned viscosity control.

While a fluorine resin dispersion having been picked up around the transfer roller is transferred to the core, the transfer roller and core are placed with a certain gap therebetween in such a manner that the fluorine resin dispersion on the transfer roller be in contact with the outer surface of the core. After a prescribed amount of the resin dispersion has been transferred onto the core, the gap is widened to cut the contact. As the gap is gradually widened, a thin film of the resin dispersion is formed by its surface tension over the transfer roller, the two thin plate provided on each side of the transfer roller, and the core while preventing the resin dispersion present on the core in contact with each end of the effective coating width from migrating inside the effective coating width. The fluorine resin dispersion being picked up around the core and that having been picked up around the transfer roller is then cut off by further continuing gap widening by shifting the core until the thin film is broken or removing the thin plates in the course of the gap widening. As a result, the amount of the fluorine resin dispersion which is picked up around the core more than necessary can be minimized thereby minimizing the difference in resin coating thickness.

The difference in thickness of the fluorine resin coat of a fixing roller can thus be minimized by the above-mentioned transfer coating method, and preferably by optimizing the viscosity of the fluorine resin dispersion to be coated.

While the aforesaid description has been concerned exclusively with a fixing roller, the method of the present invention is not limited to production of a fixing roller and can be applied to any kind of cylindrical articles such as rollers with a fluorine resin coat thereon.

The present invention is now illustrated in greater detail by way of Examples, but it should be understood that the present invention is not deemed to be limited thereto. All the percents are by weight unless otherwise indicated.

EXAMPLE 1

A primer dispersion containing 1% of polyamide-imide and 20% of PTFE (hereinafter referred to as "dispersion A"), a topcoating PTFE dispersion containing 0.2% of a filler and 50% of PTFE (hereinafter referred to as "dispersion B"), or a topcoating PFA dispersion containing 50% of PFA (hereinafter referred to as "dispersion C") each having a varied viscosity was coated on an aluminum cylinder having an outer diameter of 25 mm as a core by transfer coating according to the present invention using the transfer coating system shown in FIG. 1 under conditions (revolutions per minute of a transfer roller and a core) controlled so as to obtain a prescribed resin coating thickness. The core was shifted away from the transfer roller, and a thin film of the dispersion was broken so that the core was separated from the transfer roller. The gap between the transfer roller and the core at the time of the separation was fixed as for the same resin dispersion. After coating, the resin coating layer was baked at 380° C. for 30 minutes to obtain a sample for evaluation.

The sample was evaluated by obtaining a difference in resin coat thickness (difference between the maximum resin coat thickness and the minimum resin coat thickness). The results obtained, coating conditions, and the gap at the time of separation are shown in Tables 1 to 3 below.

TABLE 1

| | Dispersion A | | | | | | |
|---|---|---|---|---|---|---|---|
| | Sample No. | | | | | | |
| | 1 | 2 | 3 | 4 | 5 | 6 | 7 |
| Resin Dispersion Viscosity (cp) | 10 | 20 | 50 | 80 | 200 | 250 | 300 |
| Revolution of Transfer roller (rpm) | 7 | 7 | 7 | 7 | 7 | 7 | 7 |
| Revolution of Core (rpm) | 40 | 30 | 15 | 12 | 10 | 10 | 10 |
| Gap (mm) | 7 | 7 | 7 | 7 | 7 | 7 | 7 |
| Difference in Resin Coat Thickness (μm) | 6 | 8 | 15 | 15 | 25 | 32 | 40 |

TABLE 2

| | Dispersion B | | | | | | |
|---|---|---|---|---|---|---|---|
| | Sample No. | | | | | | |
| | 1 | 2 | 3 | 4 | 5 | 6 | 7 |
| Resin Dispersion Viscosity (cp) | 10 | 20 | 50 | 80 | 200 | 250 | 300 |
| Revolution of Transfer roller (rpm) | 20 | 20 | 20 | 20 | 20 | 20 | 20 |
| Revolution of Core (rpm) | 80 | 60 | 60 | 30 | 10 | 10 | 10 |
| Gap (mm) | 15 | 15 | 15 | 15 | 15 | 15 | 15 |
| Difference in Resin Coat Thickness (μm) | 7 | 7 | 8 | 15 | 26 | 35 | 40 |

TABLE 3

| | Dispersion C | | | | | | |
|---|---|---|---|---|---|---|---|
| | Sample No. | | | | | | |
| | 1 | 2 | 3 | 4 | 5 | 6 | 7 |
| Resin Dispersion Viscosity (cp) | 10 | 20 | 50 | 80 | 200 | 250 | 300 |
| Revolution of Transfer roller (rpm) | 20 | 20 | 20 | 20 | 20 | 20 | 20 |
| Revolution of Core (rpm) | 80 | 60 | 60 | 30 | 10 | 10 | 10 |
| Gap (mm) | 12 | 12 | 12 | 12 | 12 | 12 | 12 |
| Difference in Resin Coat Thickness (μm) | 8 | 6 | 8 | 17 | 25 | 31 | 38 |

As can be seen from Tables 1 to 3, if the viscosity of each fluorine resin dispersion exceeds 200 cp, the difference in resin coat thickness becomes 30 μm or greater, and if it is less than 10 cp, a resin coat withstanding practical use cannot be obtained. As long as the viscosity of the resin dispersion falls within a range of from 10 to 200 cp, a practical resin coat can be obtained with the thickness difference being controlled less than 30 μm. With the viscosity being from 20 to 80 cp, the thickness difference can further be reduced.

EXAMPLE 2

Dispersion A, B, or C used in Example 1 each having a varied viscosity within a range of from 10 to 200 cp was coated on an aluminum cylinder having an outer diameter of 25 mm as a core by transfer coating under conditions (revolutions per minute of the transfer roller and the core) controlled so as to obtain a prescribed resin coating thickness. The gap at the time of separation was varied as shown in Tables 4 to 6. After coating, the resin coating layer was baked at 380° C. for 30 minutes to obtain a sample for evaluation.

The scattering of the baked resin coat thickness was obtained by dividing (the difference between the maximum thickness and the minimum thickness) by the average thickness, the average thickness being obtained by making thickness measurements on 40 points, 8 points in the peripheral direction by 5 points in the axial direction. Further, the appearance of the baked resin coat was observed. The results of the above evaluation are shown in Tables 4 through 6.

TABLE 4

Dispersion A

| | Sample No. | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 |
| Core Diameter (mm) | 25 | 25 | 25 | 25 | 25 | 25 | 25 | 25 | 25 | 25 | 25 | 25 | 25 | 25 | 25 | 25 | 25 |
| Resin Dispersion Viscosity (cp) | 10 | 10 | 10 | 10 | 10 | 20 | 20 | 20 | 20 | 20 | 50 | 50 | 50 | 50 | 50 | 80 | 80 |
| Revolution of Transfer roller (rpm) | 7 | 7 | 7 | 7 | 7 | 7 | 7 | 7 | 7 | 7 | 7 | 7 | 7 | 7 | 7 | 7 | 7 |
| Revolution of Core (rpm) | 40 | 40 | 40 | 40 | 40 | 30 | 30 | 30 | 30 | 30 | 15 | 15 | 15 | 15 | 15 | 10 | 10 |
| Gap (mm) | 2 | 5 | 10 | 15 | 20 | 2 | 5 | 10 | 15 | 20 | 2 | 5 | 10 | 15 | 20 | 2 | 5 |
| Scatter in Resin Coat Thickness | 0.9 | 0.7 | 0.6 | 0.6 | 0.8 | 0.9 | 0.7 | 0.6 | 0.5 | 0.7 | 1.0 | 0.8 | 0.7 | 0.7 | 1.0 | 1.0 | 0.8 |
| Resin Coat Appearance | good | good | good | good | good | good | good | good | good | good | good | good | good | good | good | good | good |

| | Sample No. | | | | | | |
|---|---|---|---|---|---|---|---|
| | 18 | 19 | 20 | 21 | 22 | 23 | 24 |
| Core Diameter (mm) | 25 | 25 | 25 | 25 | 25 | 25 | 25 |
| Resin Dispersion Viscosity (cp) | 80 | 80 | 80 | 200 | 200 | 200 | 200 |
| Revolution of Transfer roller (rpm) | 7 | 7 | 7 | 7 | 7 | 7 | 7 |
| Revolution of Core (rpm) | 10 | 10 | 10 | 7 | 7 | 7 | 7 |
| Gap (mm) | 10 | 15 | 20 | 5 | 10 | 15 | 20 |
| Scatter in Resin Coat Thickness | 0.7 | 0.7 | 1.1 | 1.2 | 1.2 | 1.1 | 1.3 |
| Resin Coat Appearance | good | good | good | good | good | good | good |

TABLE 5

Dispersion B

| | Sample No. | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 |
| Core Diameter (mm) | 25 | 25 | 25 | 25 | 25 | 25 | 25 | 25 | 25 | 25 | 25 | 25 | 25 | 25 | 25 | 25 | 25 |
| Resin Dispersion Viscosity (cp) | 10 | 10 | 10 | 10 | 10 | 20 | 20 | 20 | 20 | 20 | 50 | 50 | 50 | 50 | 80 | 80 | 80 |
| Revolution of Transfer roller (rpm) | 30 | 30 | 30 | 30 | 30 | 25 | 25 | 25 | 25 | 25 | 15 | 15 | 15 | 15 | 12 | 12 | 12 |
| Revolution of Core (rpm) | 80 | 80 | 80 | 80 | 80 | 70 | 70 | 70 | 70 | 70 | 60 | 60 | 60 | 60 | 40 | 40 | 40 |
| Gap (mm) | 2 | 5 | 10 | 15 | 20 | 2 | 5 | 10 | 15 | 20 | 10 | 15 | 20 | 25 | 10 | 15 | 20 |
| Scatter in Resin Coat Thickness | 0.5 | 0.3 | 0.3 | 0.2 | 0.3 | 0.5 | 0.4 | 0.4 | 0.3 | 0.5 | 0.6 | 0.6 | 0.8 | 1.0 | 1.2 | 1.1 | 1.0 |
| Resin Coat Appearance | good | good | good | good | good | good | good | good | good | good | good | good | good | good | good | good | good |

| | Sample No. | | | | |
|---|---|---|---|---|---|
| | 18 | 19 | 20 | 21 | 22 |
| Core Diameter (mm) | 25 | 25 | 25 | 25 | 25 |
| Resin Dispersion Viscosity (cp) | 80 | 200 | 200 | 200 | 200 |
| Revolution of Transfer roller (rpm) | 12 | 10 | 10 | 10 | 10 |
| Revolution of Core (rpm) | 40 | 10 | 10 | 10 | 10 |
| Gap (mm) | 25 | 15 | 20 | 25 | 30 |

TABLE 5-continued

| Dispersion B | | | | | |
|---|---|---|---|---|---|
| Scatter in Resin Coat Thickness | 1.2 | 1.0 | 1.2 | 1.3 | 1.4 |
| Resin Coat Appearance | good | good | good | good | good |

TABLE 6

Dispersion C

| | Sample No. | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 |
| Core Diameter (mm) | 25 | 25 | 25 | 25 | 25 | 25 | 25 | 25 | 25 | 25 | 25 | 25 | 25 | 25 | 25 | 25 | 25 |
| Resin Dispersion Viscosity (cp) | 10 | 10 | 10 | 10 | 10 | 20 | 20 | 20 | 20 | 20 | 50 | 50 | 50 | 50 | 80 | 80 | 80 |
| Revolution of Transfer roller (rpm) | 25 | 25 | 25 | 25 | 25 | 20 | 20 | 20 | 20 | 20 | 17 | 17 | 17 | 17 | 15 | 15 | 15 |
| Revolution of Core (rpm) | 80 | 80 | 80 | 80 | 80 | 60 | 60 | 60 | 60 | 60 | 40 | 40 | 40 | 40 | 30 | 30 | 30 |
| Gap (mm) | 2 | 5 | 10 | 15 | 20 | 2 | 5 | 10 | 15 | 20 | 10 | 15 | 20 | 25 | 10 | 15 | 20 |
| Scatter in Resin Coat Thickness | 0.5 | 0.4 | 0.4 | 0.2 | 0.4 | 0.6 | 0.5 | 0.3 | 0.2 | 0.4 | 0.5 | 0.5 | 0.7 | 0.9 | 1.0 | 1.2 | 1.4 |
| Resin Coat Appearance | good | good | good | good | good | good | good | good | good | good | good | good | good | good | good | good | good |

| | Sample No. | | | | |
|---|---|---|---|---|---|
| | 18 | 19 | 20 | 21 | 22 |
| Core Diameter (mm) | 25 | 25 | 25 | 25 | 25 |
| Resin Dispersion Viscosity (cp) | 80 | 200 | 200 | 200 | 200 |
| Revolution of Transfer roller (rpm) | 15 | 10 | 10 | 10 | 10 |
| Revolution of Core (rpm) | 30 | 20 | 20 | 20 | 20 |
| Gap (mm) | 25 | 15 | 20 | 25 | 30 |
| Scatter in Resin Coat Thickness | 1.5 | 1.2 | 1.4 | 1.4 | 1.6 |
| Resin Coat Appearance | good | good | good | good | good |

As is apparent from Tables 4 to 6, with the viscosity of the fluorine resin dispersion falling within a range of from 10 to 200 cp and with the rpm of the transfer roller and the core being so controlled as to obtain a prescribed resin coating thickness, a resin coat having a uniform thickness and a satisfactory appearance can be obtained by setting the gap at the time of separation as follows according to the kind of the fluorine resin dispersion.

| | |
|---|---|
| 2 to 20 mm . . . | for dispersion A (primer dispersion) |
| 2 to 30 mm . . . | for dispersion B (topcoating PTFE dispersion) |
| 2 to 30 mm . . . | for dispersion C (topcoating PFA dispersion) |

EXAMPLE 3 AND COMPARATIVE EXAMPLE

Dispersions A and C as used in Example 1 were coated on a roller core in this order by transfer coating according to the present invention or by spray coating according to the conventional technique, followed by baking. The spray coated and baked resin layer was polished for surface finishing. The surface roughness of each sample was measured. The sample was mounted on a copying machine as a fixing roller to conduct a practical copying test, and the performance of the sample as a fixing roller was evaluated in terms of the degree of contamination of the cleaning pad. The results obtained are shown in Table 7 below.

TABLE 7

| Sample No. | Coating Method | Finishing | | Surface Roughness | Practical Peformance | Condition of Cleaning pad |
|---|---|---|---|---|---|---|
| | | Polishing | Re-Baking | | | |
| 1 | transfer coating | none | none | 2.0S | good | very satisfactory |
| 2 | spray coating | done | done | 1.5S | good | very satisfactory |
| 3 | spray coating | done | none | 0.5S | poor | considerably contaminated |
| 4 | spray coating | none | none | 3.5S | poor | considerably contaminated |

Where a resin coat is formed by the conventional spray coating, the coated and baked surface without being polished had a rough surface (3.5S). Even when the surface was polished to have a surface roughness of 0.5S, the polished surface was observed to have fine scratches or fluff, requiring re-baking for obtaining good results in a practical test. To the contrary, the fixing roller obtained by the transfer coating according to the present invention gave satisfactory results without requiring polishing or re-baking.

As described and demonstrated above, the process of the present invention utilizing transfer coating eliminates the necessity of polishing or re-baking of the fluorine resin coat as is required in spray coating or electrostatic coating. In addition, a fluorine resin dispersion can be coated uniformly over the entire surface of a roller core.

While the invention has been described in detail and with reference to specific examples thereof, it will be apparent to one skilled in the art that various changes and modifications can be made therein without departing from the spirit and scope thereof.

What is claimed is:

1. A process for producing a fixing roller comprising coating a fluorine resin dispersion onto a cylindrical core by using a transfer coating apparatus comprising a transfer roller having an axial width equipped with a fluorine resin dispersion temperature controller, a coating pan containing a fluorine resin dispersion, a driving system for revolving the core, and a core carrying mechanism for shifting the core, comprising the steps of bringing said core close to said transfer roller at a gap allowing said core to pick up said fluorine resin dispersion, the fluorine resin dispersion having been picked up from the coating pan by said transfer roller across its entire axial width and after an amount of the fluorine resin dispersion is transferred onto the core, widening said gap between the core and the transfer roller by shifting the core away from the transfer roller to thereby separate the core from the transfer roller, said coating apparatus further comprising a plate on both sides of said transfer roller for preventing the fluorine resin dispersion in contact with both ends of an effective coating width of the core from migrating to the inside of the effective coating width while said gap is widened.

2. A process as claimed in claim 1, wherein said fluorine resin dispersion has a viscosity of from 10 to 200 cp.

3. A process as claimed in claim 1, wherein said fluorine resin dispersion comprises at least one of polytetrafluoroethylene and/or a tetrafluoroethyleneperfluoroalkyl vinyl ether copolymer, and the dispersion may additionally contain an organic polymer.

4. A process as claimed in claim 1, wherein said fluorine resin dispersion is an aqueous dispersion comprising a fluorine resin, a coloring pigment, and at least 1% by weight of an organic polymer for improving adhesion to the core, and said gap between the transfer roller and the core at the time when the core having picked up an amount of the fluorine resin dispersion is separated from the transfer roller is from 2 to 20 mm.

5. A process as claimed in claim 1, wherein said fluorine resin dispersion is an aqueous dispersion comprising from 20 to 70% by weight of polytetrafluoroethylene, and said gap between the transfer roller and the core at the time when the core having picked up an amount of the fluorine resin dispersion is separated from the transfer roller is from 2 to 30 mm.

6. A process as claimed in claim 1, wherein said fluorine resin dispersion is an aqueous dispersion comprising from 20 to 70% by weight of a tetrafluoroethyleneperfluoroalkyl vinyl ether copolymer, and said gap between the transfer roller and the core at the time when the core having picked up an amount of the fluorine resin dispersion is separated from the transfer roller is from 2 to 30 mm.

7. A process as claimed in claim 1, further comprising moving the plates on both sides of the transfer roller in the same direction as the core in the course of shifting the core away from the transfer roller, said plates remaining in contact with the transfer roller.

* * * * *